US009656779B2

(12) United States Patent
Arki

(10) Patent No.: US 9,656,779 B2
(45) Date of Patent: May 23, 2017

(54) CARTONS AND BLANKS WITH PLEATS PROXIMATE CORNERS, AND ASSOCIATED METHODS

(71) Applicant: GRAPHIC PACKAGING INTERNATIONAL CANADA, ULC, Saint-Lambert (CA)

(72) Inventor: Kayax Diamond Arki, Winnipeg (CA)

(73) Assignee: Graphic Packaging International Canada, ULC, Saint-Lambert (CA)

( * ) Notice: Subject to any disclaimer, the term of this patent is extended or adjusted under 35 U.S.C. 154(b) by 0 days.

(21) Appl. No.: 14/848,574

(22) Filed: Sep. 9, 2015

(65) Prior Publication Data

US 2016/0068297 A1 Mar. 10, 2016

Related U.S. Application Data

(60) Provisional application No. 62/048,421, filed on Sep. 10, 2014.

(51) Int. Cl.
*B65D 5/36* (2006.01)
*B65D 5/462* (2006.01)
*B65D 5/46* (2006.01)

(52) U.S. Cl.
CPC ..... *B65D 5/3642* (2013.01); *B65D 5/46112* (2013.01); *B65D 5/46144* (2013.01)

(58) Field of Classification Search
CPC .. B65D 5/3642; B65D 5/4608; B65D 5/4266; B65D 5/4208; B65D 5/4279; B65D 5/46112; B65D 5/3635; B65D 5/3657; B65D 5/365; B31B 1/76; B31B 2201/281
USPC ..... 229/117.15, 186
See application file for complete search history.

(56) References Cited

U.S. PATENT DOCUMENTS 1,926,366 A * 9/1933 Bergstein ..... B65D 5/3642 229/117.07
2,357,009 A * 8/1944 Klein ..... B65D 5/3642 229/117.04
2,545,802 A * 3/1951 Bergstein ..... B65D 5/3642 229/117.07
2,713,963 A * 7/1955 Andrews ..... B65D 5/3657 229/145
2,957,617 A * 10/1960 Bolding ..... B65D 5/3642 229/117.04

(Continued)

FOREIGN PATENT DOCUMENTS

FR 2 365 488 4/1978
FR 2365488 A1 * 4/1978 ..... B65D 5/3642

OTHER PUBLICATIONS

International Search Report and Written Opinion for PCT/IB2015/001989 dated Feb. 20, 2016.

*Primary Examiner* — Gary Elkins
(74) *Attorney, Agent, or Firm* — Womble Carlyle Sandridge & Rice, LLP

(57) ABSTRACT

A collapsible box-like container or carton may be formed from a unitary foldable blank divided by fold lines into a bottom panel, a pair of side panels, a pair of end panels and corner sections. Each corner section may include triangular corner or pleat panels divided by a diagonal or oblique fold line. The triangular corner or pleat panels may be folded in intimate face-to-face contact on the outer surface of the adjacent end panels. Some of the triangular corner or pleat panels may be adhesively secured to the outer surface the adjacent end panel.

29 Claims, 6 Drawing Sheets

(56) References Cited

U.S. PATENT DOCUMENTS

| | | | | |
|---|---|---|---|---|
| 3,386,644 | A * | 6/1968 | Zackheim | A61B 10/0045 229/117.03 |
| 5,284,294 | A | 2/1994 | Floyd | |
| 5,335,845 | A * | 8/1994 | Liu | B65D 5/48018 229/117.07 |
| 5,853,121 | A | 12/1998 | Francisco | |
| 6,253,993 | B1 | 7/2001 | Lloyd et al. | |
| 8,109,433 | B2 | 2/2012 | De Paula et al. | |
| 8,556,160 | B2 | 10/2013 | Spivey, Sr. | |
| 2001/0004088 | A1 | 6/2001 | Lau | |
| 2004/0031842 | A1 | 2/2004 | Westerman et al. | |
| 2005/0023331 | A1 * | 2/2005 | Hirschey | B65D 5/46112 229/117.15 |
| 2011/0147444 | A1 | 6/2011 | Fitzwater | |

* cited by examiner

CARTONS AND BLANKS WITH PLEATS PROXIMATE CORNERS, AND ASSOCIATED METHODS

CROSS-REFERENCE TO RELATED APPLICATION

This application claims the benefit of U.S. Provisional Patent Application No. 62/048,421, filed on Sep. 10, 2014.

INCORPORATION BY REFERENCE

The disclosure of U.S. Provisional Patent Application No. 62/048,421, which was filed on Sep. 10, 2014, is hereby incorporated by reference for all purposes as if presented herein in its entirety.

TECHNICAL FIELD

This application relates generally to foldable containers and, more particularly, to a carton that may be at least partially leak-proof.

BACKGROUND

Cartons that are at least partially leak-proof are known. Such cartons may require various steps and manipulations before being erected from a collapsed state to a fully erected state. Some cartons with leak-proof features are generally configured such that sidewalls of the carton may need to be manually folded and held by hand or with a device while the operator fills the carton.

There is a desire for a container, or more specifically a carton, that provides a new balance of properties.

SUMMARY

An aspect of this disclosure is the provision of a container, which may more specifically be in the form of a carton, having pleats proximate its upright corners. The pleats may be positioned outwardly of side panels of the carton. A bottom panel of the carton may be cooperatively configured with the side panels and pleats to form a downwardly-closed container that is sift-proof. The blank from which the carton is at least partially formed may include at least one suitable waterproof, moisture proof, water resistant or moisture resistant coating, so that the downwardly-closed container can be waterproof, moisture proof, water resistant or moisture resistant.

In one example, a carton may include: a bottom panel; a first side panel foldably connected to the bottom panel; a second side panel foldably connected to the bottom panel, wherein the bottom panel may be positioned between the first and second side panels; a third side panel foldably connected to the bottom panel, wherein the third side panel may have opposite inner and outer sides; a first plurality of pleat panels foldably connected between the first side panel and the third side panel, wherein a first pleat panel of the first plurality of pleat panels may be mounted to the outer side of the third side panel; and a second plurality of pleat panels foldably connected between the second side panel and the third side panel, wherein a first pleat panel of the second plurality of pleat panels may be mounted to the outer side of the third side panel. At least some of the pleat panels may be substantially triangular.

In one aspect of this disclosure, the first pleat panel of the first plurality of pleat panels has opposite inner and outer sides. The outer side of the third side panel and an inner side of the first pleat panel of the first plurality of pleat panels may face toward one another and be adhesively connected to one another. The carton may be adapted to be reconfigured between a substantially flat configuration and an erected configuration, and the first plurality of pleat panels may further include a second pleat panel foldably connected to the first pleat panel of the first plurality of pleat panels by an oblique fold line. When the carton is in the substantially flat configuration, the first and second pleat panels of the first plurality of pleat panels may be substantially coplanar with one another. When the carton is in the erected configuration, the first and second pleat panels of the first plurality of pleat panels may be in opposing face-to-face relation with one another.

When the carton is being erected, respective pleat panels may pull the third and fourth side panels so that the third and fourth side panels pivot outwardly and upwardly in response to upward and outward pivoting of the first and second side panels. When the carton is being collapsed, respective pleat panels may pull the first and second side panels so that the first and second side panels pivot inwardly and downwardly in response to downward and inward pivoting of the third and fourth side panels.

The carton may further include a plurality of flaps respectively foldably connected to the first, second, third and fourth side panels, wherein the flaps may be cooperatively configured to at least partially form a top closure of the carton. The flaps may be cooperatively configured to at least partially secure (e.g., releasably secure) the top closure in an at least partially closed configuration.

An aspect of this disclosure is the provision of a container, or more particularly a carton, that may be quickly erected, and that may remain open by itself while the container is being loaded. The carton may remain open by itself once erected, so that it can remain open without being held open by hand or with any other device, thereby freeing both hands of an operator to fill the container. Accordingly, the carton may be economically transported in a collapsed state, stored, and thereafter rapidly opened and filled.

One aspect of this disclosure is the provision of collapsible box-like container or carton comprising a unitary foldable blank divided by fold lines into a plurality of panels. The plurality of panels may include a bottom panel, a pair of side panels, a pair of end panels and four pairs of corner sections or pleats. Each corner section may be divided into triangular corner panels or pleat panels by a diagonal or oblique fold line. The triangular corner panels or pleats may be folded in intimate face-to-face contact on the outer surface of the adjacent end panels, wherein a first one of each pair of triangular panels or pleats may be adhesively secured to the outer surface of the adjacent end panel.

Another aspect of this disclosure is the provision of a method of forming a collapsible container from a flat blank having a plurality of integrally interconnected panels articulated to one another along fold lines. The plurality of panels may include a bottom panel, a pair of side panels, a pair of end panels and a pair of triangular corner panels (e.g., pleat panels) between each side panel and its adjacent end panel. The method may include folding the triangular corner panels of each pair of corner panels in intimate face-to-face contact to form a V-fold or pleat on an outer surface of an adjacent one of the end panels, and adhesively securing an innermost one of each of the triangular corner panels to the adjacent end panels.

The foregoing presents a simplified summary of some aspects of this disclosure in order to provide a basic understanding. The foregoing summary is not an extensive summary of the disclosure and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which are not necessarily drawn to scale. The drawings are exemplary only, and should not be construed as limiting the invention.

DETAILED DESCRIPTION

Examples of embodiments are described below and illustrated in the accompanying drawings, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. For example, features illustrated or described as part of one embodiment can be used in the context of another embodiment to yield a further embodiment, and these further embodiments are within the scope of the present invention.

Figure 1:
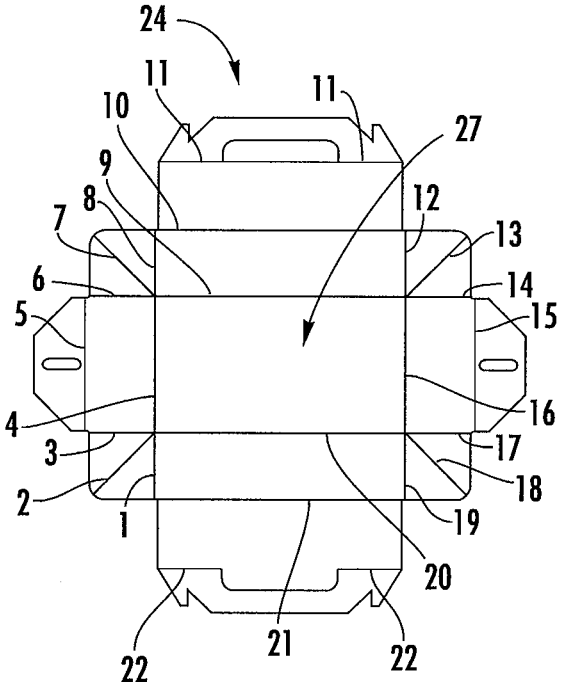
FIG. 1 is a plan view of what may be referred to as an interior side of a blank, wherein the blank is in a flat configuration, in accordance with a representative embodiment of this disclosure.
Figure 2:
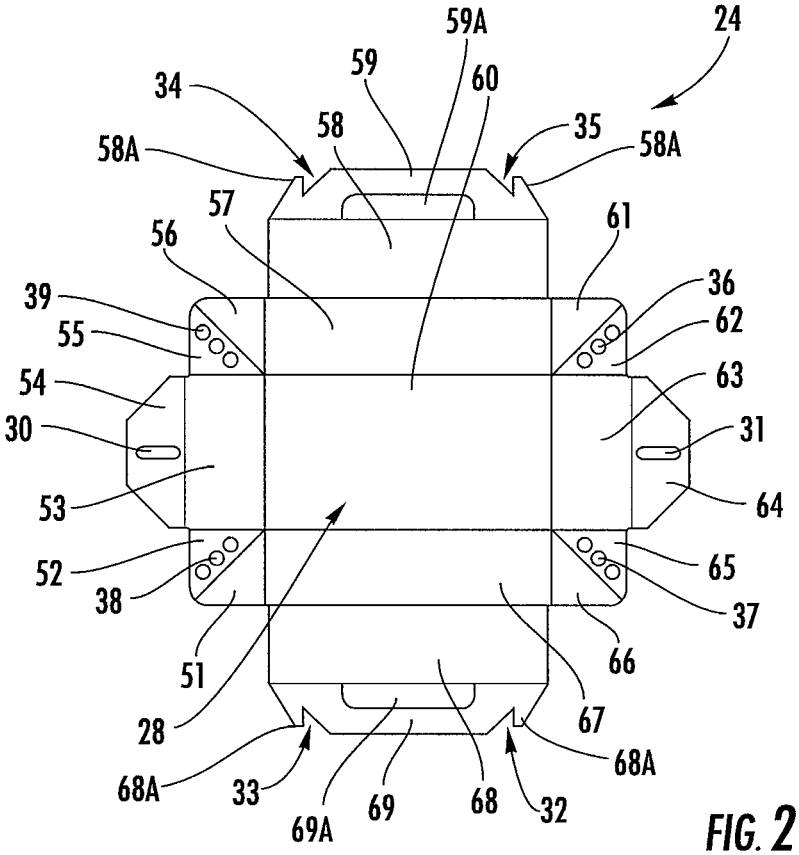
FIG. 2 is a plan view of what may be referred to as an exterior side of the blank of FIG. 1 in the flat configuration, wherein dots of adhesive material are shown on the exterior side of the blank, in accordance with the representative embodiment.

Referring now in greater detail to the drawings, FIGS. 1 and 2 illustrate a unitary, generally rectangular blank 24, in accordance with a representative embodiment of this disclosure. As will be discussed in greater detail below, the blank 24 may be referred to as a carton blank, and in one example the blank may be quickly folded to form a substantially seamless box-like container or carton 26 (FIGS. 7-11). More specifically, at least a lower portion of the carton 26 may be seamless, sift-proof, waterproof, moisture proof, water resistant and/or moisture resistant, as will be discussed in greater detail below.

As respectively shown in FIGS. 1 and 2, the blank 24 has opposite sides that may be respectively referred to as interior and exterior sides 27, 28. As shown in FIGS. 1 and 2, the blank 24 has a plurality of fold lines respectively designated by reference numerals 1 through 22 in FIG. 1. Each of the fold lines 1-22 may be in the form of a score line and/or one or more other suitable lines of disruption, or the like.

The fold lines 1-22 are cooperatively configured to defining numerous individual panels of the blank 24, wherein the reference numerals for designating the panels are shown in FIG. 2. More particularly, the blank 24 may have a generally rectangular bottom panel 60 bounded by side panels 53, 57, 63, 67. Whereas differently configured side panels 53, 57, 63, 67 panels are within the scope of this disclosure, for the representative embodiment the side panels 57, 67 may be referred to as longitudinal side panels 57, 67, and the side panels 53, 63 may be referred to as end panels 53, 63. The side panels 57, 67 may be respectively foldably or pivotally interconnected to opposite edges of the bottom panel 60 by way of fold lines 9, 20. The end panels 53, 63 may be respectively pivotally interconnected to opposite edges of the bottom panel 60 by way of fold lines 16, 4.

The blank 24 may further include in each of four opposite corners thereof a pair of foldably interconnected triangular corner or pleat panels 51, 52; 55, 56; 61, 62; 65, 66. As will be seen hereinafter, for each pair of triangular corner or pleat panels 51, 52; 55, 56; 61, 62; 65, 66, the panels of the pair may be adapted to be brought together in intimate face-to-face contact with one another to form a V-fold or pleat, and one of the panels of the pair or pleat may be adhesively mounted to an exterior or outer surface of the respective end panel 53, 63.

The first pair of triangular corner or pleat panels 51, 52 may be pivotally interconnected to the end panel 53 by way of fold line 17 and to side panel 67 by way of fold line 19. The second pair of triangular corner or pleat panels 55, 56 may be pivotally interconnected to the end panel 53 by way of fold line 14 and to side panel 57 by way of fold line 12. The third pair of triangular corner or pleat panels 61, 62 may be pivotally interconnected to the end panel 63 by way of fold line 6 and to side panel 57 by way of fold line 8. Finally, the fourth pair of triangular corner or pleat panels 65, 66 may be pivotally interconnected to the end panel 63 by way of fold line 3 and to side panel 67 by way of fold line 1.

The first pair of triangular corner or pleat panels 51, 52 may be pivotally interconnected with one another by way of a first diagonal or oblique fold line 18. The second pair of triangular corner or pleat panels 55, 56 may be pivotally interconnected with one another by way of a second diagonal or oblique fold line 13. The third pair of triangular corner or pleat panels 51, 52 may be pivotally interconnected with one another by way of a third diagonal or oblique fold line 7. The fourth pair of triangular corner or pleat panels 65, 66 may be pivotally interconnected with one another by way of a fourth diagonal or oblique fold line 2.

Figure 11:
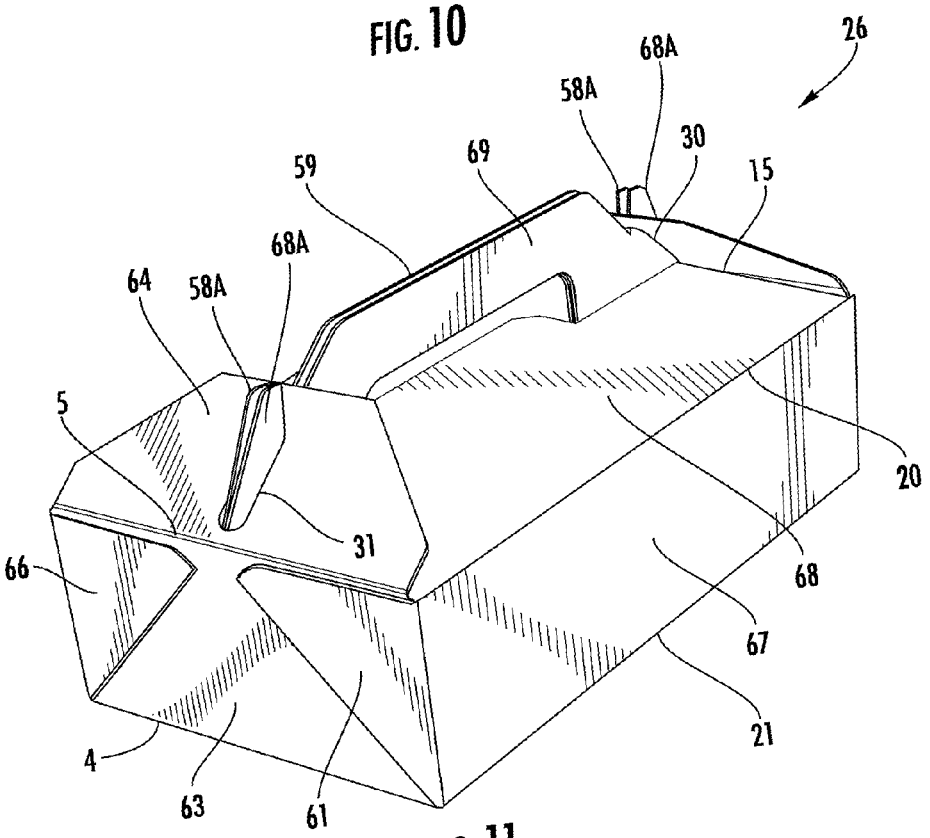
FIG. 11 is a pictorial view of the carton of FIG. 7 in an erected, closed configuration, in accordance with the representative embodiment.

The blank 24 may further comprise top side flap panels 58, 68 respectively pivotally interconnected to the side panels 57, 67 by way of fold lines 10, 21. The top side flap panels 58, 68 may be referred to as side flaps for the sake of brevity. Top end flap panels 54, 64 may be provided as well for engagement with the side flaps 58, 68 in order to at least partially close the top open end of the carton 26 as shown in FIG. 11. The top end flap panels 54, 64 may be referred to as end flaps for the sake of brevity. The end flaps 54, 64 may be respectively pivotally interconnected to the end panels 53, 63 by way of fold lines 5, 15.

The blank 24 may further comprise handle panels 59, 69 respectively pivotally interconnected to the side flaps 58, 68. The right handle panel 59 may be pivotally connected to side flap 58 by way of at least one fold line 11, wherein segments of the fold line 11 may be interrupted by a handle hole 59A that extends through the right handle panel, and the segments may be referred to as being separate fold lines. The left handle panel 69 may be pivotally interconnected to side flap 68 by way of at least one fold line 22, wherein segments of the fold line 22 may be interrupted by a handle hole 69A that extends through the left handle panel, and the segments may be referred to as being separate fold lines.

The handle panels 59, 69 may be characterized as being respective portions of the side flaps 58, 68. For example, each of the side flaps 58, 68 may be a multi-panel flap that includes the respective handle panel 59, 69, the fold lines 11, 22 may be omitted and/or the handle panels 59, 69 may be omitted. As another example, a first composite flap may include both the side flap 58 and the handle panel 59, wherein the first composite flap may be pivotally interconnected to the side panel 57 by fold line 10. Similarly, a second composite flap may include both the side flap 68 and the handle panel 69, wherein the second composite flap may be pivotally interconnected to the side panel 67 by fold line 22.

The end and side flaps 54, 57, 64, 67 may be cooperatively configured to at least partially form a top closure of the carton 26, as shown in FIG. 11 and as will be discussed in greater detail below. In this regard, one or more of the end and side flaps 54, 57, 64, 67 may include fastener parts that may be cooperatively configured to at least partially secure the top closure in an at least partially closed configuration. For example and referring to FIG. 2, fastener parts of the end flaps 54, 64 may be in the form of holes 30, 31 respectively extending through the end flaps, wherein the holes 30, 31 may more specifically be referred to as, or be in the form of, locking slots 30, 31. As another example, fastener parts of the side flaps 58, 68 may respectively be in the form of protrusions or tabs 58A, 68A of the side flaps 58, 68 or the handle panels 59, 69. More specifically and as shown in FIG. 2, V-shaped slots 34, 35 may be defined in the right handle panel 59 to form the tabs 58A (e.g., locking fingers) for engagement with (e.g., for being received in) the locking slots 30, 31 defined in the end flaps 54, 64 to at least partially secure the top closure in the at least partially closed configuration. Likewise, V-shaped slots 32, 33 may be defined in the left handle panel 69 to form the tabs 68A (e.g., locking fingers) for engagement with (e.g., for being received in) the locking slots 30, 31 defined in the end flaps 54, 64 to at least partially secure the top closure in the at least partially closed configuration. Alternatively, the top closure, end and side flaps 54, 57, 64, 67 and handle panels 59, 69 may be omitted.

Figure 3:
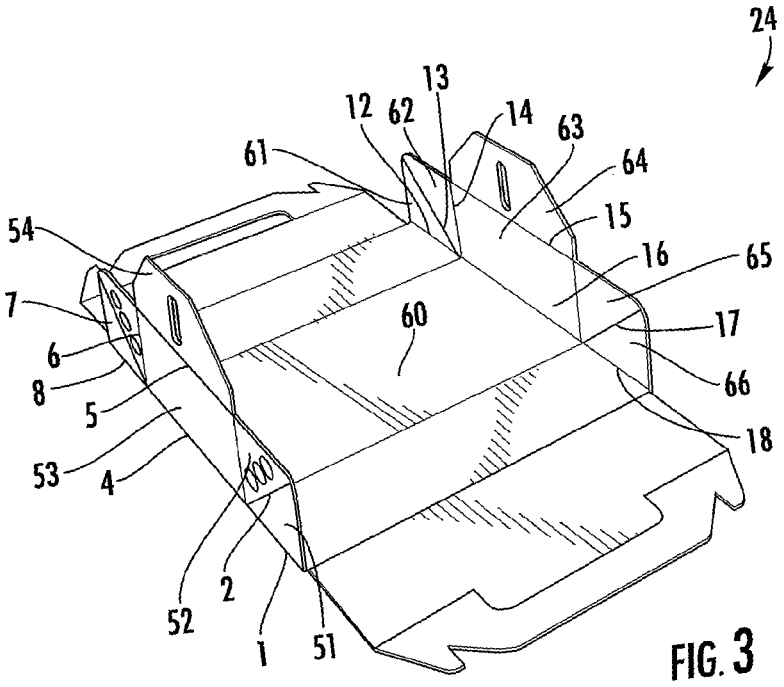
FIG. 3 is a pictorial view of the blank of FIG. 1 in a partially erected configuration, wherein end panels of the blank are in a partially folded position, and the partially erected configuration shown in FIG. 3 may be illustrative of the blank being in the middle of a first folding step of a representative method of forming the blank into a container or carton, in accordance with the representative embodiment.

FIGS. 2-6 illustrate successive steps for forming the carton 26 from the blank 24, in accordance with an example of a method of the representative embodiment, as described in the following. First, the blank 24 of may be laid flat with the interior side 27 of the blank facing upward, as shown in FIG. 1. Then, as shown in FIG. 3, the folding process may begin by folding up the end panels 53, 63 and the triangular corner or pleat panels 51, 52; 55, 56; 61, 62; 65, 66 about respective fold lines 1, 4, 8, 12, 16, 19. The end panels 53, 63 and the triangular corner or pleat panels 51, 52; 55, 56; 61, 62; 65, 66 may be brought into face-to-face contact with the inner side of the bottom panel 60 and the side panels 57, 67. Then, as best understood with reference to FIGS. 2 and 4, suitable adhesive material, such as glue, may be applied to what may be referred to as the inner side of the triangular corner or pleat panels 62, 65, 52, 55. For example, the adhesive material is schematically represented by dots 36, 37, 38, 39 in FIGS. 2 and 4, although the adhesive material may be in any other suitable location and/or configuration, such by being upon respective portions of the end panels 53, 63.

Figure 4:
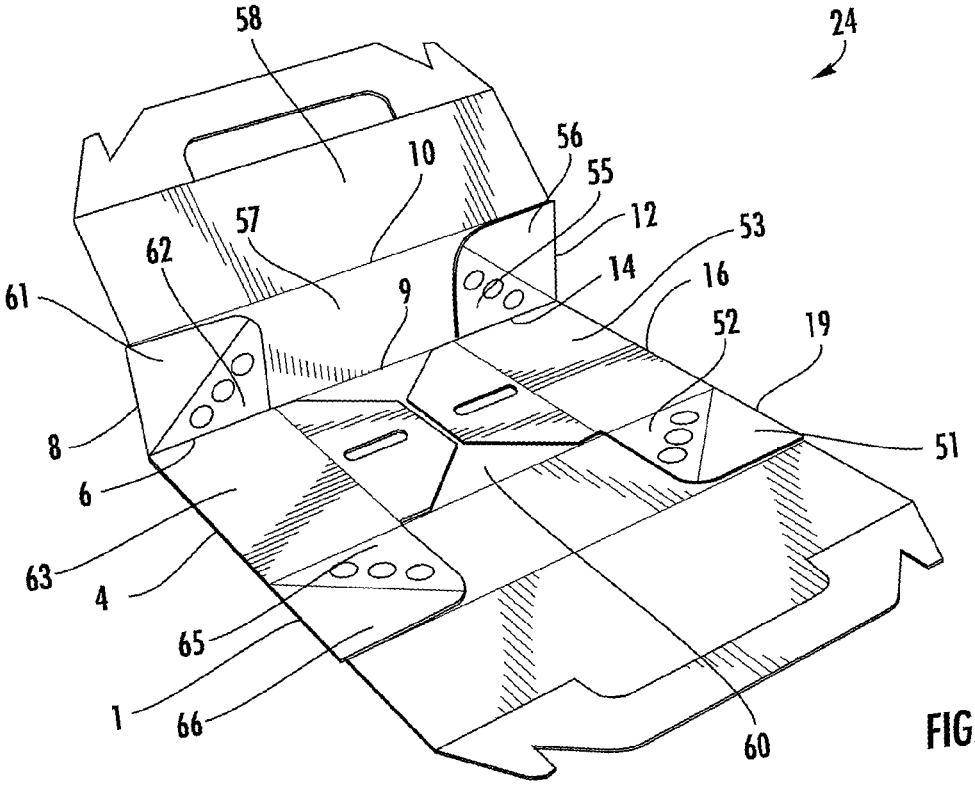
FIG. 4 is a pictorial view of the blank of FIG. 1 in another partially erected configuration, wherein the partially erected configuration shown in FIG. 4 may be illustrative of the blank during a second folding step of the representative method, wherein a pair of corner or pleat panels are approaching an end panel for being adhered thereto, in accordance with the representative embodiment.
Figure 5:
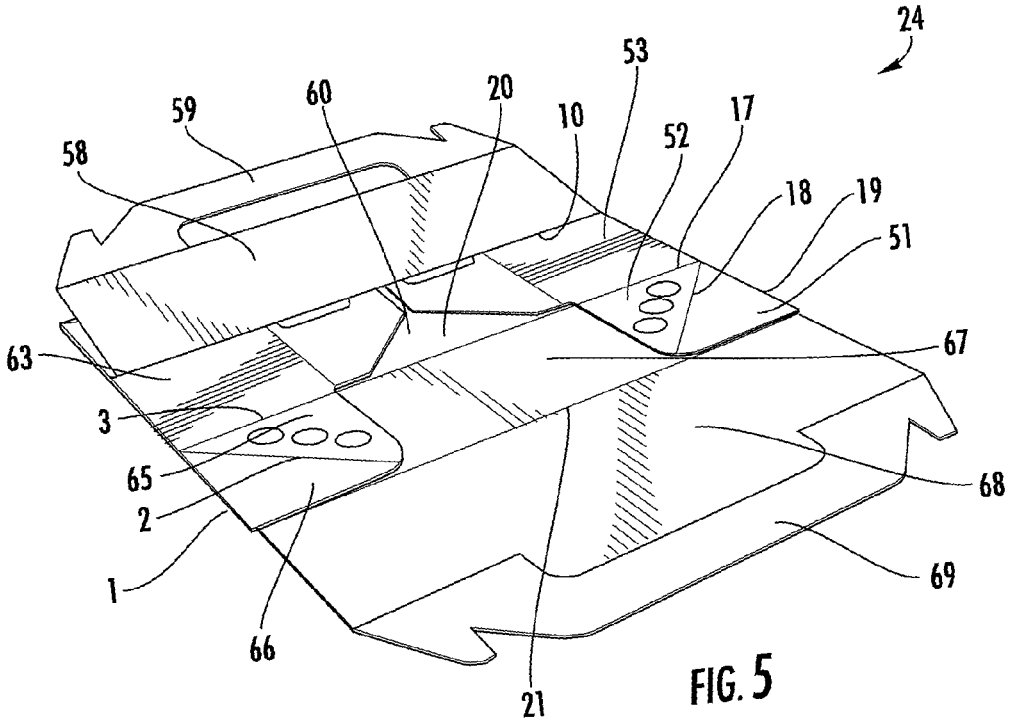
FIG. 5 is a pictorial view of the blank of FIG. 1 in an partially erected configuration that may exist at the end of the second folding step, wherein a side panel is fully folded, in accordance with the representative embodiment.

Referring to FIG. 4, after the application of the adhesive 36, 37, 38, 39, a first side panel 57 may be folded up about its associated fold line 9, thereby causing the interconnected triangular corner or pleat panels 61, 62, 55, 56 to pivot upwardly together with the first side panel 57. Thereafter, as partially shown in FIG. 5, the side flap 58 connected to the first side panel 57 may be folded over outwardly about its fold line 10 and the first side panel 57 (FIG. 4) may be further pivoted towards the interior side 27 of the blank 24 so as to bring the associated two pairs of triangular corner or pleat panels 61, 62, 55, 56 (FIG. 4) into intimate contact with the outer sides of the end panels 63, 53, thereby causing the triangular corner or pleat panels 62, 55 on which the adhesive has been applied to become adhesively bonded to the outer sides of the end panels 63, 53.

Figure 6:
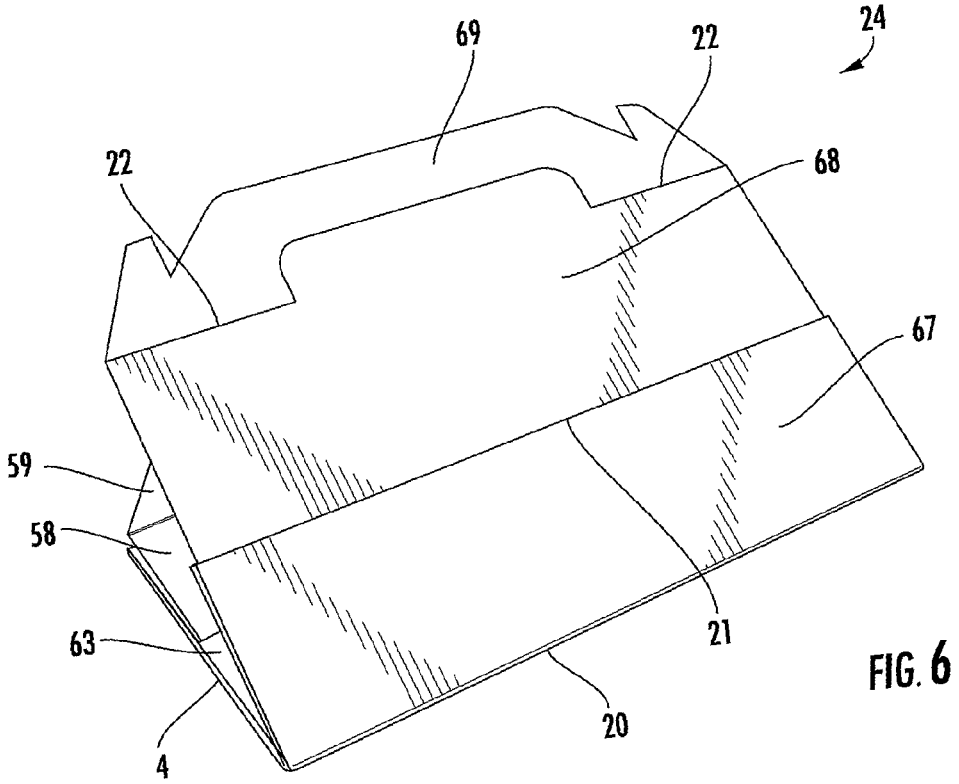
FIG. 6 is a pictorial view of the blank of FIG. 1 in another partially erected configuration, wherein the partially erected configuration shown in FIG. 6 may be illustrative of the blank during a third folding step of the representative method, wherein another pair of corner or pleat panels are approaching another end panel for being adhered thereto, in accordance with the representative embodiment.
Figure 7:
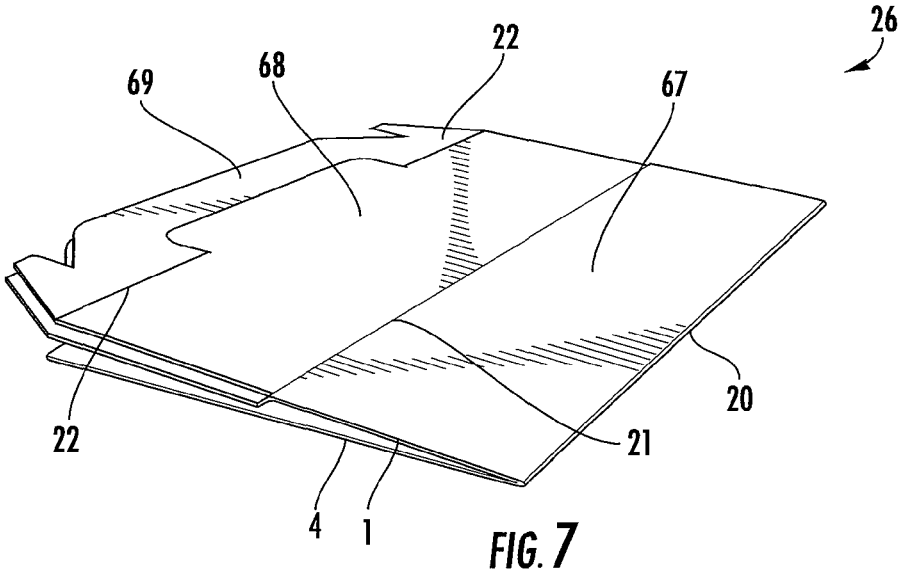
FIG. 7 is a pictorial view of the blank of FIG. 1 in a configuration that exists at the end of the third folding step, wherein the blank has been transformed into a container or carton in a substantially flat, collapsed configuration, in accordance with the representative embodiment.
Figure 8:
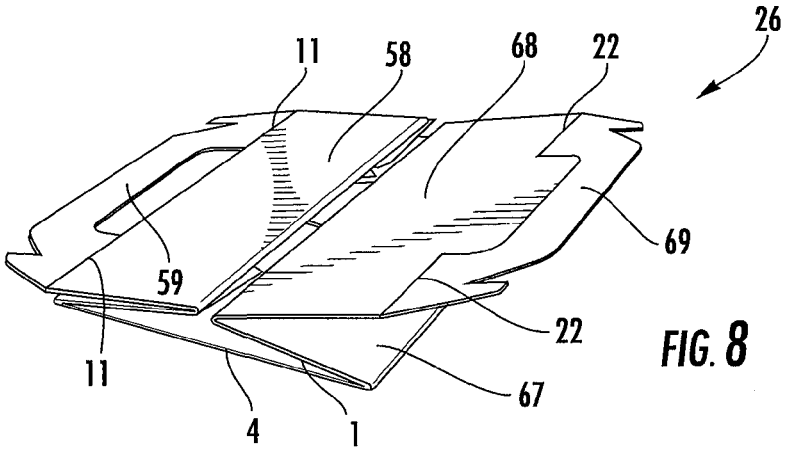
FIG. 8 is a pictorial view of the carton of FIG. 7 in a partially erected configuration, wherein and relative to collapsed configuration of FIG. 7, the partially erected configuration shown in FIG. 8 may be substantially illustrative of the carton proximate the end of a first erecting step, in accordance with the representative embodiment.
Figure 9:
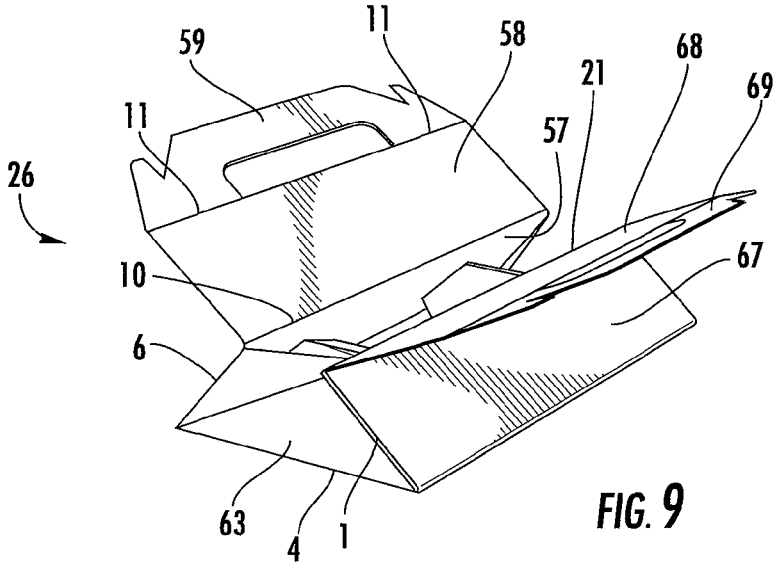
FIG. 9 is a pictorial view of the carton of FIG. 7 in another partially erected configuration, wherein the partially erected configuration shown in FIG. 9 may be substantially illustrative of the carton during a second erecting step, in accordance with the representative embodiment.

Then, as shown in FIG. 6, the opposite side of the blank 24 may be folded in a similar way as discussed above with reference to the first side panel 57 in order to complete the assembly of the carton 26. For example, FIG. 7 shows the carton 26 is an assembled, substantially flat configuration. After having been assembled as described above, the carton 26 may be shipped or stored in a minimal volume flat collapsed state as, for example, shown in FIG. 7. In the collapsed configuration, the corner or pleat panels 51, 52;

55, 56; 61, 62; 65, 66 may be substantially coplanar with one another. The connecting provided by the adhesive material 36, 37, 38, 39 may be supplemented with, or replaced by, other suitable fastening mechanisms.

Figure 10:
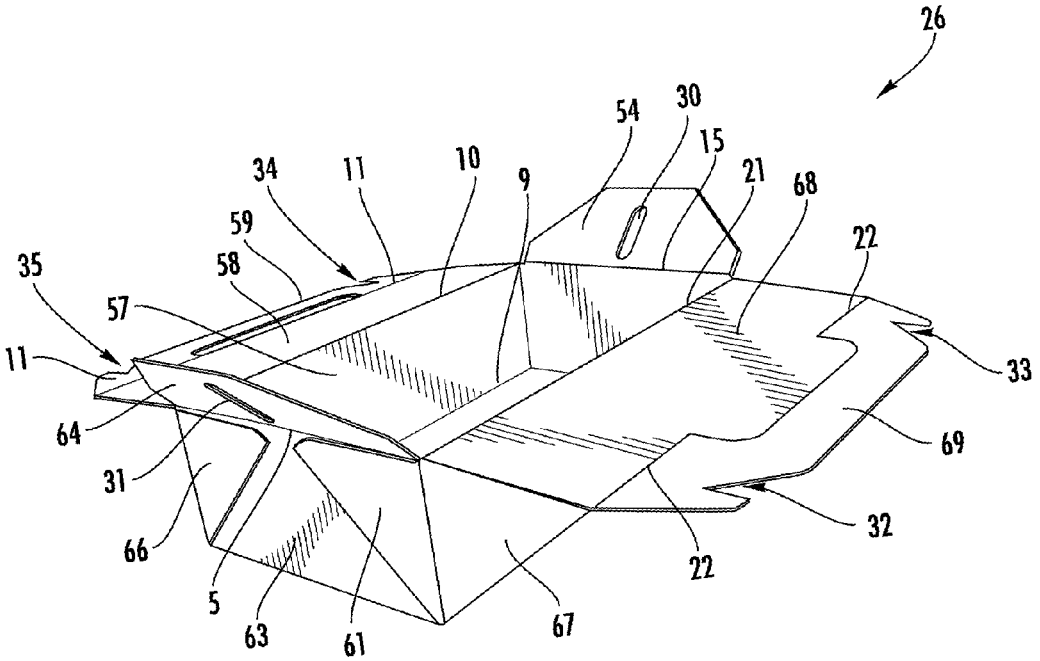
FIG. 10 is a pictorial view of the carton of FIG. 7 in an erected, open configuration, in accordance with the representative embodiment.

In accordance with an example of a method of the representative embodiment, the carton 26 can be readily erected or deployed from its collapsed position, as described in the following. For example and referring to FIGS. 8 and 9, the carton 26 may be erected by simply pivoting (e.g., folding) the side flaps 58, 68 outwardly away from each other and by then unfolding the side panels 57, 67 away from the bottom panel 60 as per the two-step sequence illustrated in FIGS. 8 and 9. Simultaneously or thereafter, the end panels 53, 63 can be pivoted away from the bottom panel 60 to an upright position in order to provide the fully erected carton 26, as shown in FIG. 10. In the erected configuration, for each pair of the corner or pleat panels 51, 52; 55, 56; 61, 62; 65, 66, the pleat panels may be in opposing face-to-face relation, or more particularly opposing face-to-face contact, with one another.

As one example, in response to the side panels 57, 67 being folded away from the bottom panel 60, the pleat panels 51, 56, 61, 66 may pull the end panels 53, 63 so that the end panels are automatically pivoted away from the bottom panel 60 toward an upright configuration of the end panels. If necessary or helpful, the pivoting of the end panels 53, 63 away from the bottom panel 60 toward or to their upright configuration may be partially or completely facilitated by way of direct manual manipulation of the end panels.

The pivoting of the end panels 53, 63 from their collapsed or folded position to their erected position causes the triangular corner or pleat panels 51, 56, 61, 66 to pivot about their respective diagonal or oblique fold lines 2, 7, 13, 18 into face-to-face contact with the associated triangular corner or pleat panels 52, 55, 62, 65 which may be adhesively bonded to the outer surface of the end panels 53, 63, thereby forming generally triangular strengthening members or pleats on the outer surface of the end panels. For the representative embodiment, this arrangement can at least partially allow the carton 26 to remain in an open erected configuration (FIG. 10) without any external support. This may facilitate loading of the carton 26 in that the operator does not have to hold the sides of the container to prevent the same from collapsing during the loading operation.

As shown in FIG. 11, the top open end of the carton 26 can be releasably closed by folding the side flaps 58, 68 inwardly so as to bring the handles 59, 69 together, and by then folding the end flaps 54, 64 thereover so as to engage the tabs 58A, 68A (e.g., locking fingers) formed at opposed ends of the side flaps 58, 68 into the locking slots 30, 31 defined in the end flaps 54, 64.

In another example of erecting the carton, the side panels 57, 67 may be referred to as first and second side panels 57, 67, and the end panels 53, 63 may be referred to as third and fourth side panels 53, 63. The erecting of the carton 26 may include a manual or machine-implemented folding of the first and second side panels 57, 67 relative to the bottom panel 60, wherein the folding of the first and second side panels may be comprised of the first and second side panels pivoting away from one another, pivoting away from the bottom panel, and pivoting outwardly relative to an interior of the carton. The third side panel 53 may automatically fold relative to the bottom panel 60 in response to the folding of the first and second side panels 57, 67, wherein the folding of third side panel may be comprised of the pleat panels 51, 56 respectively foldably connected between the third side panel and the first and second side panels pulling the third side panel so that the third side panel pivots away from the bottom panel and the fourth side panel, and outwardly relative to the interior of the carton. The fourth side panel 63 may automatically fold relative to the bottom panel 60 in response to the folding of the first and second side panels 57, 67, wherein the folding of fourth side panel may be comprised of the pleat panels 61, 66 respectively foldably connected between the fourth side panel and the first and second side panels pulling the fourth side panel so that the fourth side panel pivots away from the bottom panel and the third side panel, and outwardly relative to the interior of the carton 26.

After use, the carton 26 can be flattened back to its collapsed configuration (e.g., FIG. 7), such as for storage purposes. For example, a method of at least partially collapsing the carton 26 from its upwardly open, erected configuration (e.g., FIG. 10) may include a manual or machine-implemented inward folding of the third and fourth side panels 53, 63 relative to the bottom panel 60, wherein the inward folding of the third and fourth side panels may be comprised of the third and fourth side panels pivoting toward one another, toward the bottom panel 60, and inwardly relative to the interior of the carton. The first side panel 57 may automatically fold relative to the bottom panel 60 in response to the inward folding of the third and fourth side panels 53, 63, wherein this folding of first side panel 57 may be comprised of the pleat panels 56, 61 respectively foldably connected between the first side panel 57 and the third and fourth side panels 53, 63 pulling the first side panel 57 so that the first side panel 57 pivots toward the bottom panel 60 and the second side panel 67, and inwardly relative to the interior of the carton 26. Similarly, the second side panel 67 may automatically fold relative to the bottom panel 60 in response to the inward folding of the third and fourth side panels 53, 63, wherein this folding of the second side panel may be comprised of the pleat panels 51, 66 respectively foldably connected between the second side panel 67 and the third and fourth side panels 53, 63 pulling the second side panel 67 so that the second side panel 67 pivots toward the bottom panel 60 and the first side panel 57, and inwardly relative to the interior of the carton 26. If necessary or helpful, the pivoting of the first and second side panels 57, 67 toward the bottom panel 60 toward and their collapsed configurations may be partially or completely facilitated by way of direct manual manipulation of the first and second side panels.

Figure 12:
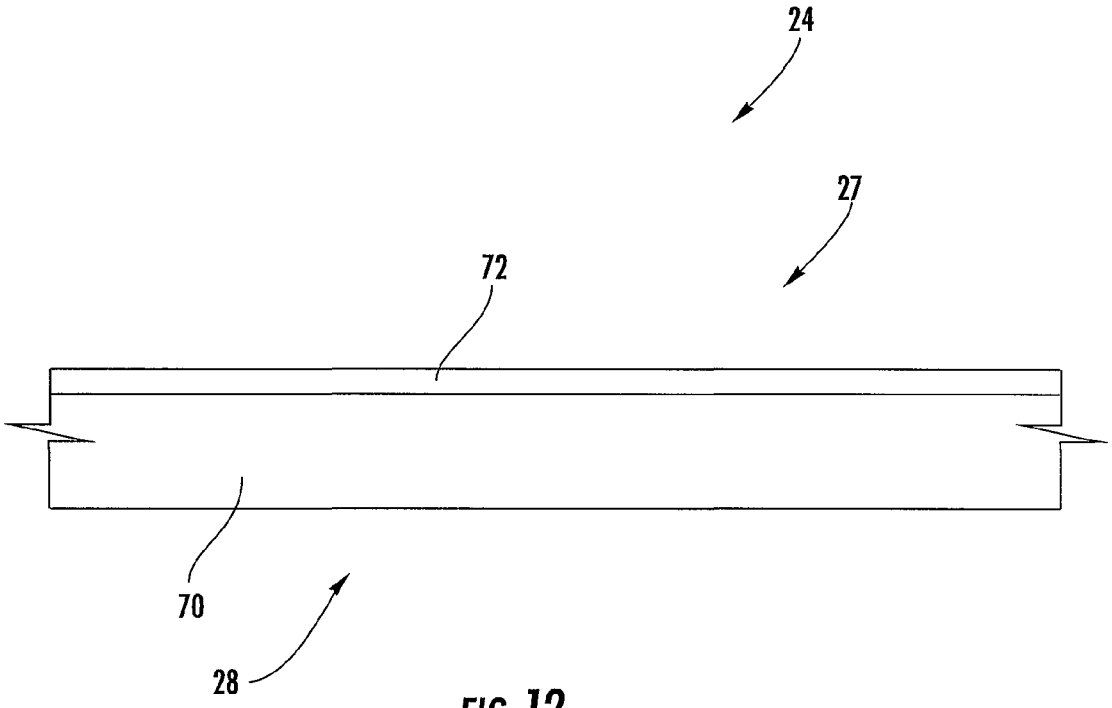
FIG. 12 is an enlarged, cross-sectional view of a portion of the blank of FIGS. 1 and 2, in accordance with the representative embodiment.

In the representative embodiment, and as best understood with reference to FIG. 12, the blank 24 may be made of a suitable substrate 70, such as paperboard or cardboard, with at least one suitable waterproof, moisture proof, water resistant and/or moisture resistant coating 72 mounted to the substrate and defining the interior side 27 of the blank and/or the exterior side 28 of the blank.

More generally, the blank 24 may be formed from coated paperboard and similar materials. For example, the interior and/or exterior sides of the blank 24 can be coated with a clay coating. The clay coating may then be printed over with product, advertising, price coding, and other information or images. The blank 24 may then be coated with a varnish to protect any information printed on the blank. The blank 24 may also be coated with, for example, a moisture barrier layer 72, on either or both sides of the blank. The blank 24 may be constructed of paperboard of a caliper such that it is heavier and more rigid than ordinary paper. The blank 24 can also be constructed of other materials, such as cardboard, hard paper, or any other material having properties suitable for enabling the carton 26 to function at least generally as described herein.

As another example, the substrate 70 may comprise a paper or paperboard. The paperboard may have a basis weight of from about 60 to about 330 lb/ream, for example, from about 80 to about 140 lb/ream. The paperboard generally may have a thickness of from about 6 to about 30 mils, for example, from about 12 to about 28 mils. In one particular example, the paperboard has a thickness of about 14 mils. Any suitable paperboard may be used, for example, a solid bleached sulfate board, for example, Fortress® board, commercially available from International Paper Company, Memphis, Tenn., or solid unbleached sulfate board, such as SUS® board, commercially available from Graphic Packaging International, Atlanta, Ga. Alternatively, the substrate 70 may comprise a polymer, for example, CPET.

The coating 72 may comprise polymeric material. For example, the coating 72 may be applied as a dispersion via roll coating, spraying and/or in any other suitable manner. As another example, the coating 72 may be a applied by way of extrusion coating, laminating and and/or in any other suitable manner. The coating may comprise polyvinylidene chloride (PVDC), flexible polyvinyl chloride (PVC), polypropylene and/or any other suitable materials.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

In one aspect of this disclosure, the blank 24 may be configured to provide for a quick erection of a self-supporting leak-proof container 26, which can have the ability to remain open by itself once fully erected.

The above description is meant to provide examples, and the above examples are not intended to limit the scope of the present invention. It will be understood by those skilled in the art that while the present disclosure has been discussed above with reference to examples, various additions, modifications and changes can be made thereto without departing from the spirit and scope of the invention as set forth in the claims.

What is claimed is:

1. A carton in a substantially flat configuration and adapted to be reconfigured between at least an erected configuration and the substantially flat configuration, comprising:

a bottom panel;

a first side panel foldably connected to the bottom panel;

a second side panel foldably connected to the bottom panel, the bottom panel being positioned between the first and second side panels;

a third side panel foldably connected to the bottom panel, the third side panel having opposite inner and outer sides;

a first plurality of pleat panels foldably connected between the first side panel and the third side panel, wherein a first pleat panel of the first plurality of pleat panels is mounted to the outer side of the third side panel;

a second plurality of pleat panels foldably connected between the second side panel and the third side panel, wherein a first pleat panel of the second plurality of pleat panels is mounted to the outer side of the third side panel; and a plurality of flaps comprising a first flap foldably connected to the first side panel at a first fold line and a second flap foldably connected to the second side panel at a second fold line, the first fold line being adjacent to the second fold line such that the first flap is in flush alignment with and face-to-face contact with the second flap.

2. The carton of claim 1, wherein at least some pleat panels of at least some of the first and second pluralities of pleat panels are substantially triangular.

3. The carton of claim 1, wherein:

the first pleat panel of the first plurality of pleat panels has opposite inner and outer sides;

the outer side of the third side panel and the inner side of the first pleat panel of the first plurality of pleat panels face toward one another; and the carton comprises adhesive material fixedly connecting the outer side of the third side panel and an inner side of the first pleat panel of the first plurality of pleat panels to one another.

4. The carton of claim 3, wherein:

the first plurality of pleat panels comprises a second pleat panel foldably connected to the first pleat panel of the first plurality of pleat panels by an oblique fold line; and the first and second pleat panels of the first plurality of pleat panels are in opposing face-to-face relation with one another when the carton is in the erected configuration.

5. The carton of claim 3, wherein:

when the carton is in an erected configuration, the first, second, and third side panels collectively extend around an interior of the carton;

the first plurality of pleat panels comprises a second pleat panel foldably connected to the first pleat panel of the first plurality of pleat panels by an oblique fold line; and the first and second pleat panels of the first plurality of pleat panels are in opposing face-to-face relation with one another when the carton is in the erected configuration.

6. The carton of claim 1, further comprising a third flap foldably connected to the third side panel, the first, second, and third flaps being cooperatively configured to at least partially form a top closure of the carton when the carton is in the erected configuration.

7. The carton of claim 6, wherein:

the first flap of the plurality of flaps comprises a first fastener part;

the second flap of the plurality of flaps comprises a second fastener part; and the first and second fastener parts are cooperatively configured to at least partially secure the top closure in an at least partially closed configuration when the carton is in the erected configuration.

8. The carton of claim 6, wherein:

the plurality of flaps comprises a fourth flap foldably connected to a fourth side panel;

the third flap comprises a first hole;

the fourth flap comprises a second hole;

the first flap and second flap each comprise a tab configured to fit into at least one of the first hole and the second hole to at least partially secure the top closure in an at least partially closed configuration when the carton is in the erected configuration.

9. The carton of claim 8, wherein:

the first flap further comprises a handle panel, and the tab of the first flap is part of the handle panel; and the second flap further comprises a handle panel, and the tab of the second flap is part of the handle panel of the second flap.

10. The carton of claim 1, wherein the first side panel has a first width, the second side panel has a second width, the bottom panel has a bottom width, and the first width and the second width are each equal to a half of the bottom width.

11. The carton of claim 10, wherein the first flap comprises a first side flap and a first handle panel, the second flap comprises a second side flap and a second handle panel, the first side flap and the second side flap each having a flap width equal to the first width and the second width.

12. The carton of claim 8, wherein the first hole is spaced apart from the third side panel and the second hole is spaced apart from the fourth side panel.

13. A blank for being formed into a carton and in a substantially flat configuration and adapted to be reconfigured between at least an erected configuration and the substantially flat configuration, the blank comprising:

a bottom panel;

a first side panel having opposite inner and outer edges, the inner edge of the first side panel being foldably connected to the bottom panel;

a second side panel having opposite inner and outer edges, the inner edge of the second side panel being foldably connected to the bottom panel, and the bottom panel being positioned between the first and second side panels;

a third side panel having opposite inner and outer edges, the inner edge of the third side panel being foldably connected to the bottom panel;

a first plurality of pleat panels foldably connected between the first side panel and the third side panel;

a second plurality of pleat panels foldably connected between the second side panel and the third side panel;

a fourth side panel having opposite inner and outer edges, the inner edge of the fourth side panel being foldably connected to the bottom panel, and the bottom panel being positioned between the third and fourth side panels;

a third plurality of pleat panels foldably connected between the first side panel and the fourth side panel;

a fourth plurality of pleat panels foldably connected between the second side panel and the fourth side panel; and a plurality of flaps respectively foldably connected to the outer edges of the first, second, third and fourth side panels; the outer edge of the first side panel being adjacent the outer edge of the second side panel such that a first flap foldably connected to the first side panel is in flush alignment with and face-to-face contact with a second flap foldably connected to the second side panel, the plurality of flaps being cooperatively configured to at least partially form a top closure when the blank is formed into a carton and in the erected configuration.

14. The blank of claim 13, wherein the first plurality of pleat panels comprises first and second pleat panels that are foldably connected to one another by an oblique fold line.

15. The blank of claim 13, wherein at least some pleat panels of at least some of the first, second, third and fourth pluralities of pleat panels are substantially triangular.

16. The blank of claim 13, wherein:

a first flap of the plurality of flaps comprises a first fastener part;

a second flap of the plurality of flaps comprises a second fastener part; and the first and second fastener parts are cooperatively configured to at least partially secure the top closure in an at least partially closed configuration when the blank is formed into the carton and in the erected configuration.

17. The blank of claim 13, wherein:

a plurality of flaps comprises a first flap foldably connected to the outer edge of the first side panel, a second flap foldably connected to the outer edge of the second side panel, a third flap foldably connected to the outer edge of the third side panel, and a fourth flap foldably connected to the outer edge of the fourth side panel;

the third flap comprises a first hole;

the fourth flap comprises a second hole;

the first flap and the second flap each comprise at least one tab configured to fit into at least one of the first hole and the second hole to at least partially secure the top closure in an at least partially closed configuration when the blank is formed into the carton and in the erected configuration.

18. The blank of claim 13, wherein the first flap is foldably connected to the first side panel at a first fold line and the second flap is foldably connected to the second side panel at a second fold line, the first fold line being adjacent to the second fold line.

19. The blank of claim 13, wherein the first side panel has a first width, the second side panel has a second width, the bottom panel has a bottom width, and the first width and the second width are each equal to a half of the bottom width.

20. The blank of claim 19, wherein the plurality of flaps comprises a first flap foldably connected to the first side panel and comprising a first side flap and a first handle panel, and a second flap foldably connected to the second side panel and comprising a second side flap and a second handle panel, the first side flap and the second side flap each having a flap width equal to the first width and the second width.

21. The blank of claim 17, wherein the first hole is spaced apart from the third side panel and the second hole is spaced apart from the fourth side panel.

22. A method of configuring a carton into a substantially flat configuration and the carton adapted to be reconfigured between at least an erected configuration and the substantially flat configuration and comprising a bottom panel, a first side panel foldably connected to the bottom panel, a second side panel foldably connected to the bottom panel, a third side panel foldably connected to the bottom panel, pleat panels respectively foldably connected between the third side panel and the first and second side panels, a fourth side foldably connected to the bottom panel, and pleat panels respectively foldably connected between the fourth side panel and the first and second side panels, and a plurality of flaps comprising a first flap foldably connected to the first side panel at a first fold line and a second flap foldably connected to the second side panel at a second fold line, the first fold line being adjacent to the second fold line such that the first flap is in flush alignment with and face-to-face contact with the second flap, the method comprising:

at least partially erecting the carton from the substantially flat configuration, wherein the at least partially erecting is comprised of folding the first and second side panels relative to the bottom panel, wherein the folding of the first and second side panels is comprised of the first and second side panels pivoting away from one another, away from the bottom panel, and outwardly relative to an interior of the carton;

the third side panel folding relative to the bottom panel in response to the folding of the first and second side panels, wherein the folding of third side panel is comprised of at least some of the pleat panels respectively foldably connected between the third side panel and the first and second side panels pulling the third side panel so that the third side panel pivots away from the bottom panel and the fourth side panel, and outwardly relative to the interior of the carton; and the fourth side panel folding relative to the bottom panel in response to the folding of the first and second side panels, wherein the folding of the fourth side panel is comprised of at least some of the pleat panels respectively foldably connected between the fourth side panel and the first and second side panels pulling the fourth side panel so that the fourth side panel pivots away from the bottom panel and the third side panel, and outwardly relative to the interior of the carton.

23. The method of claim 22, wherein the folding of the first, second, third and fourth side panels occurs substantially simultaneously.

24. The method of claim 22, wherein the pleat panels respectively foldably connected between the third side panel and the first and second side panels comprise:

a first pleat panel foldably connected between the first side panel and the third side panel; and a second pleat panel foldably connected between the second side panel and the third side panel.

25. The method of claim 22, wherein the pleat panels respectively foldably connected between the fourth side panel and the first and second side panels comprise:

a first pleat panel foldably connected between the first side panel and the fourth side panel; and a second pleat panel foldably connected between the second side panel and the fourth side panel.

26. The method of claim 22, further comprising at least partially collapsing the carton, wherein the at least partially collapsing is comprised of:

an inward folding the third and fourth side panels relative to the bottom panel, wherein the inward folding of the third and fourth side panels is comprised of the third and fourth side panels pivoting toward one another, toward the bottom panel, and inwardly relative to the interior of the carton;

an inward folding of the first side panel relative to the bottom panel in response to the inward folding of the third and fourth side panels, wherein the inward folding of first side panel is comprised of at least some of the pleat panels respectively foldably connected between the first side panel and the third and fourth side panels pulling the first side panel so that the first side panel pivots toward from the bottom panel and the second side panel, and inwardly outwardly relative to the interior of the carton; and an inward folding of the second side panel relative to the bottom panel in response to the inward folding of the third and fourth side panels, wherein the inward folding of the second side panel is comprised of at least some of the pleat panels respectively foldably connected between the second side panel and the third and fourth side panels pulling the second side panel so that the second side panel pivots toward the bottom panel and the first side panel, and inwardly relative to the interior of the carton so that the first fold line is adjacent to the second fold line.

27. The method of claim 22, wherein the first side panel has a first width, the second side panel has a second width, the bottom panel has a bottom width, and the first width and the second width are each equal to a half of the bottom width.

28. The method of claim 27, wherein the first flap comprises a first side flap and a first handle panel, and the second flap comprises a second side flap and a second handle panel, the first side flap and the second side flap each having a flap width equal to the first width and the second width.

29. The method of claim 26, wherein the at least partially collapsing the carton comprises positioning the first flap to be in flush alignment with and face-to-face contact with the second flap.

* * * * *